US006382930B1

(12) United States Patent
Bahnen et al.

(10) Patent No.: US 6,382,930 B1
(45) Date of Patent: May 7, 2002

(54) SCREW VACUUM PUMP PROVIDED WITH ROTORS

(75) Inventors: Rudolf Bahnen, Roetgen; Thomas Dreifert, Köln, both of (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 09/529,433

(22) PCT Filed: Jun. 19, 1998

(86) PCT No.: PCT/EP98/03757

§ 371 Date: Apr. 10, 2000

§ 102(e) Date: Apr. 10, 2000

(87) PCT Pub. No.: WO99/19631

PCT Pub. Date: Apr. 22, 1999

(30) Foreign Application Priority Data

Oct. 10, 1997 (DE) ..... 197 45 615

(51) Int. Cl.[7] ..... F04B 49/00
(52) U.S. Cl. ..... 417/310
(58) Field of Search ..... 417/310, 304, 417/410.4; 418/152, 201.3, 9, 312

(56) References Cited

U.S. PATENT DOCUMENTS

| | | | | |
|---|---|---|---|---|
| 3,807,911 A | | 4/1974 | Caffrey | |
| 5,791,888 A | * | 8/1998 | Smith | 418/149 |
| 5,954,489 A | * | 9/1999 | Kinoshita | 418/179 |
| 6,019,586 A | * | 2/2000 | Liou | 418/202 |

FOREIGN PATENT DOCUMENTS

| | | |
|---|---|---|
| DE | 1428026 | 12/1968 |
| EP | 0 362757 A2 | 4/1990 |
| FR | 1290239 | 3/1962 |
| FR | 1500160 | 9/1967 |
| GB | 464493 | 5/1937 |
| GB | 785860 | 11/1957 |
| JP | 3 111690 | 5/1991 |

* cited by examiner

*Primary Examiner*—Teresa Walberg
*Assistant Examiner*—Vinod D. Patel
(74) *Attorney, Agent, or Firm*—Fay, Sharpe, Fagan, Minnich & McKee, LLP

(57) ABSTRACT

A screw vacuum pump (1) has rotors (5), bearings (7, 8), a casing (4), a suction side (15), and a delivery side (24). Each of the rotors includes at least two rotor sections, a suction side rotor section (17) and a delivery side rotor section (18). The two rotor sections are separately constructed and joined together in a positive, form-fitting or friction locking manner. The suction side rotor section is preferably larger in diameter and constructed with looser tolerances as compared to the delivery side rotor section. The suction side rotor is preferably of an inexpensive material such as aluminum while the discharge side rotor is preferably constructed of a higher performance material such as stainless steel. The rotor sections are supported on a rotor shaft (6) into which cooling fluid is injected through a cooling pipe (33). Cooling fluid from the shaft is also circulated through the bearings and passages in the casing eventually reaching a sump (37) in preparation for recirculation.

21 Claims, 1 Drawing Sheet

SCREW VACUUM PUMP PROVIDED WITH ROTORS

BACKGROUND OF THE INVENTION

The present invention relates to a screw vacuum pump with rotors. It finds particular application to the production of screw vacuum pumps wherein production is relatively expensive owing to the special shape of the rotors and casing where, in addition, the casing and rotors need to be produced relatively accurately so as to avoid undesirably large clearances between the rotors themselves and between the rotors and the casing. Large clearances result in too wide gaps which impair the pump's operating properties owing to backstreaming in the gaps.

In the case of an already proposed screw vacuum pump of the aforementioned kind, each of the rotors is made of a single piece comprising two sections having differing rotor profiles. During the usual metal removing production process for screw rotors of this kind it is necessary to provide a relatively large-volume run out for the tool between the sections having different profiles. Dead spaces of this kind not only impair the operating properties of the pump, they also oppose the goal of producing pumps which are as compact as possible. However, in certain applications, it may be advantageous, for the purpose of relieving the pressure, to provide a circular groove at the plane where the profile of the thread changes, but this groove will generally not have to be of the size of a large-volume run out for a tool.

It is an objective of the present invention to produce a screw vacuum pump of the aforementioned kind in a more cost-effective manner than previously possible. To satisfy this objective, it is proposed that each of the rotors of the screw vacuum pump consist of at least two separately manufactured rotor sections, joined together either by positive form-fitting or by friction locking. The significant advantage of the present invention is that the rotor sections may be produced from different materials and/or with differing degrees of accuracy so as to be in a position to adapt these to the physical necessities (thermal conductivity, thermal expansion, corrosion resistance, weight, distribution of mass etc.) in the affected area of the pumping chamber. For example, the rotor section on the suction side, which is stressed less thermally, may be made of aluminum; whereas, the rotor section on the delivery side, which is subjected to higher thermal stresses, may be made of steel. In particular, the accuracy requirements for the screw profiles of both sections may be adapted to the required sealing effects. In the suction area, any backstreaming will only have an insignificant effect on the effective pumping speed of the pump. Thus the screw profile located in this area may be produced with significantly greater tolerances, i.e. in a more cost-effective manner. Higher accuracy requirements need only to be met in the area of the delivery side. Rotor sections having different profiles may be combined in such a manner that there exists a smooth transition between the differing screw profiles. Detrimental dead spaces are no longer present. A shorter length or height can be implemented.

Lower cost materials may also be selected for the components of the pump, even when the pump is equipped with a cooling facility which, at the same time, ensures a uniform temperature distribution. Thermal expansion problems may then be mastered more easily. Finally, the present invention allows, in the case of a screw vacuum pump, the utilization of the modular principle so as to adapt it to the specific application. Through volume, pitch and/or the length of the profiles on the suction side, it is possible to influence the pumping speed or the base pressure. Through a smaller gradation, a higher fluid compatibility, and by a larger gradation, a lower power consumption or a higher pumping speed at a relatively lower power consumption may be attained.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
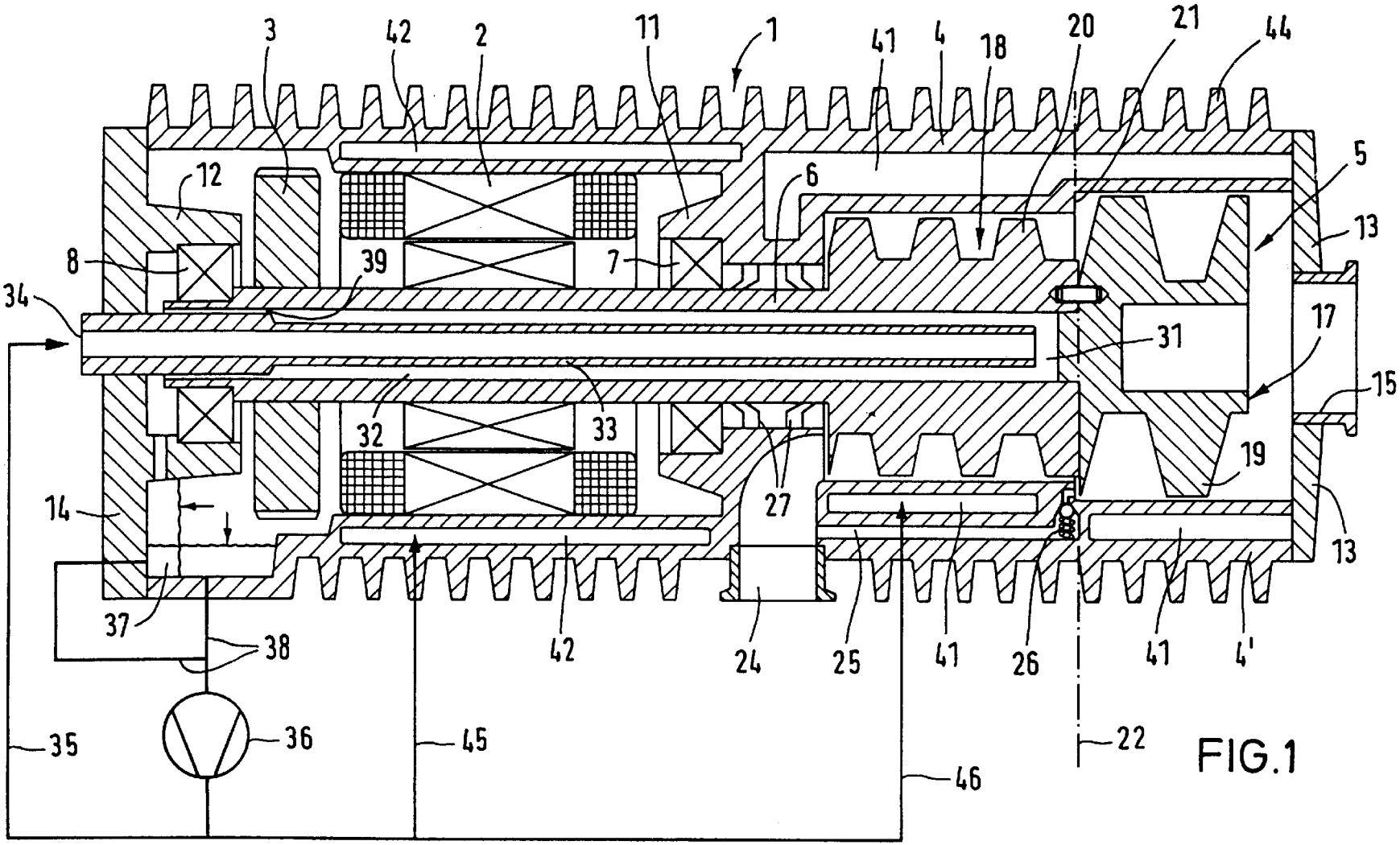
FIG. 1 is a sectional view through a screw vacuum pump designed according to the present invention.

With reference to FIG. 1, a sectional view is depicted through a screw vacuum pump 1, designed according to the present invention, at the plane of a system of two rotary systems of which one of said rotary systems is equipped with drive motor 2. The two rotating systems are synchronized with the aid of toothed wheels 3.

The rotating systems, which are accommodated in a casing 4, each comprise a rotor 5 and a shaft 6. Each rotor 5 is equipped with a cantilevered bearing, i.e. with a bearing on one side. Shaft 6 is supported in the casing 4 via bearings 7 and 8 as well as bearing supports 11 and 12. Provided on the face sides are casing lids 13, 14 of which the lid 13 on the rotor side is equipped with an inlet port 15. Bearing support 12 is part of the lid 14 on the side of the gear.

The rotor 5 consists of two rotor sections 17 and 18, joined together by positive form-fitting, having differing profiles 19 and 20. Rotor section 17 on the suction side has a large-volume profile 19 for attaining high volume flows in the helical pump chamber. Section 18 of rotor 5 has, on the delivery side, a profile which is reduced in its volume, and it also has a smaller diameter. Thus the cross section of the helical pump chambers is reduced. An inner compression is attained, and the work done on compression is reduced.

The inner wall of casing 4 is adapted to the gradation of the rotor (gradation 21). A dash-dot line 22 indicates that the casing may be designed to be partible at the plane of gradation 21. Thus it is possible, for the purpose of adapting the pump to differing applications, to replace rotor section 17 on the suction side and section 4' on the suction side of the casing 4 by other rotor sections having different profiles, lengths and/or diameters, having casing sections 4' adapted to these as well.

The outlet of pump 1, downstream of the thread on the delivery side, is designated as 24. It is led out to the side. Moreover, a bore 25 in the casing opens into the outlet, said bore linking the pump chamber to the outlet at the plane where the cross section of the pump chamber reduces-be it through gradation and/or by changing the profile of the thread. Located in casing bore 25 is a non-return valve 26 which opens in the case of overpressures within the pump chamber and which short-circuits the thread on the suction side of rotor 17 with the outlet 24. Shaft seals 27 which are located between bearing 7 and rotor section 18 are provided for sealing the helical pump chambers against the bearings.

The cooling system for the embodiment of the present invention presented comprises a cooling arrangement for the inside of the rotor and a jacket facility cooling for the casing.

For the purpose of cooling the inside of the rotor, the rotor 5 is equipped with a hollow space 31 which is open to the rotor's bearing side and which may extend almost the entire length of rotor 5. In the case of the rotor 5 consisting of two sections 17 and 18, section 18 on the delivery side is preferably designed to be hollow. Section 17 on the suction side seals off the suction-sided end of hollow space 31. The shaft 6, which preferably is designed as a single component with rotor 5 or the section 18 on the delivery side of rotor 5, is also designed to be hollow (hollow space 32). Located in the hollow spaces 31, 32 is a central cooling pipe 33, which on the side of the bearing runs out of shaft 6 and which on the rotor side ends just ahead of the end of hollow space 31 on the suction side. The cooling pipe 33 and an annular chamber formed by the cooling pipe 33 and the hollow shaft 6 are available for feeding and discharging of a coolant.

In the design example presented, the opening 34 of cooling pipe 33 on the side of the bearing is linked via line 35 to the outlet of a coolant pump 36. Moreover, a coolant sump 37 is located in the area of casing lid 14, said sump being connected via the system of lines 38 are so designed, that the pump 1 presented may be operated in any orientation between vertical and horizontal. Coolant levels which set themselves up in the horizontal and the vertical position of the pump 1 are depicted. Depending on the location of the coolant pump 36 outside (as depicted) or inside (for example, on the second, not visible, shaft of pump 1 at the plane of the drive motor 2) of the casing 4, the opening 34 of the cooling pipe 33 is located outside or inside of casing 4.

To operate the inside cooling facility of rotor 5, the coolant is pumped by coolant pump 36 out of the coolant sump 37 through the cooling pipe 33 into hollow space 31 within rotor 5. From there it flows via the annular chamber between cooling pipe 33 and shaft 6 back into the sump 37. The hollow space 31 is located at the plane of the threads on the delivery side of pump 1, so that precisely this area is cooled effectively. The coolant flowing back outside of cooling pipe 33 cools, among other items, the hollow shaft 6, the bearings 7 and 8, the drive motor 2 (on the side of the armature) and the toothed wheels 3, so that thermal expansion problems are reduced.

Preferably the cross section of the annular chamber between cooling pipe 33 and shaft 6 in the area of its end on the delivery side is reduced, for example, by the cooling pipe 33 having in this area a greater outside diameter. Thus a constricted passage 39 is created. This constriction ensures that all spaces which carry the coolant are completely filled.

It may be expedient to select, as the material for the cooling pipe 33, a material of low thermal conductivity (for example plastic/stainless steel or alike). Thus a more effective cooling of rotor 5 and uniform cooling of those components of pump 1 which are located in the vicinity of the shaft is attained.

The presented jacket cooling facility for the casing comprises hollow spaces or channels in casing 4. Cooling channels provided in the area of the rotor 5 are designated as 41, cooling channels located in the area of the motor 2 are designated as 42.

It is the task of the cooling channels 41 located in the area of the rotor 5 to dissipate the heat which forms, especially in the area on the delivery side of the rotor 5. On the other hand, they shall equalize the temperature of the casing 4 at the plane of the entire rotor in the best possible manner. Finally they shall dissipate the heat taken up to the outside. For this reason, the hollow spaces 41 through which the coolant flows extend over the entire length of the rotor 5. Casing lid 13 serves the purpose of sealing the hollow spaces in channels 41 on the suction side. Also on the outlet side, casing 4 is cooled effectively.

Cooling channels 42 located at the plane of the drive motor 2 also perform the same tasks as described for channels 41. They uniformly cool the drive motor (on the side of the coils) as well as the bearing support 7. Finally, they considerably increase the dissipation of heat through the outer surfaces of pump 1. Preferably, these are equipped, at least at the plane of the cooling channels 41 and 42, with cooling fins 44.

Coolant is supplied into cooling channels 41, 42 also with the aid of the coolant pump 36, specifically via lines 45 and 46 if they are to be supplied in parallel. Depending on the thermal requirements, there also exists the possibility of supplying the coolant into these channels in sequence. One of the lines 45 or 46 could then be omitted. Via bores not depicted in detail, the coolant passes from the hollow spaces 41, 42 back into the sump 37.

In case shaft 6 is arranged vertically, the coolant in the sump will cool the bearing support 12 protruding into the sump 37. in the case of a horizontal arrangement, it is expedient to let the returning coolant flow over the inside of lid 14, so as to cool bearing seat 12 and improve the dissipation of heat to the outside.

In the exemplary design according to drawing FIG. 1, casing 4 and rotor 5 are-as already detailed-designed to be partible at the plane of line 22. Thus there exists the possibility of replacing the sections of rotor 5 on the suction side (section 17) and casing 4 (section 4') by other components. The pump 1 may be adapted to various applications by fitting rotor sections 17 with different profiles 19, of different length, different pitch and/or different diameter in each case, combined with an adapted casing section. Profiles of different sizes for the suction side may be selected for the purpose of attaining high pumping speeds, profiles differing in length may be selected to attain lower base pressures and/or different volume gradations may be selected to attain, for example, in the case of a low gradation a higher compatibility with fluids or, in the case of a higher gradation, a higher pumping speed at a relatively low power consumption. Finally, there exists the possibility of providing a circumferential groove at the plane of the reduced diameter of rotor 5 for relieving the pressure in this area in the case of certain applications.

The coolant flowing through the screw vacuum pump 1 may be water, oil (mineral oil, PTFE oil or alike) or a different fluid. Expedient is the use of oil so as to also lubricate the bearings 7, 8 and the toothed wheels 3. Separate guiding of coolant and lubricant, as well as the corresponding seals, may thus be omitted. It only needs to be ensured that oil is supplied to the bearings 7, 8 in a controlled manner.

The solutions detailed permit an advantageous selection of materials. For example, the rotors 5 and the casing 4 may consist of relatively more cost-effective aluminum materials. The proposed cooling arrangement and, above all, uniform cooling of pump 1 have the effect that, even at differing operating temperatures and relatively small gaps, which are a direct result of small clearances, play is not locally consumed which would result in contacts between rotor and rotor, and/or rotor and casing. A further reduction of the gaps is possible if materials having a lower coefficient of thermal expansion, compared to the materials for the thermally less stressed casing 4, are employed for the inner components of pump 1 (rotors, bearings, bearing supports, toothed wheels) which are exposed to higher thermal stresses. Thus a more moderate equalization regarding the expansion of all components of pump 1 is attained. An exemplary selection of materials is steel (nickel chromium steel, for example) for the inner components and aluminum for the casing. Also bronze, brass or China (German) silver may be employed as the materials for the inner components.

What is claimed is:

1. An evacuation apparatus having rotors, bearings, a casing, a suction side and a delivery side, each of the rotors of the screw vacuum pump including at least two separately manufactured rotor sections joined by one of (1) positive form-fitting and (2) friction-locking, a first of the rotor sections on the suction side having a larger diameter compared to a one of the rotor sections on the delivery side.

2. The pump according to claim 1 wherein each of the rotor sections has differing rotor profiles.

3. A screw vacuum pump having rotors, bearings, a casing, a suction side and a delivery side, wherein each of the rotors of the screw vacuum pump comprises at least two joined separately manufactured rotor sections constructed of different materials from each other.

4. The pump according to claim 3 wherein a first of the rotor sections on the suction side has a larger diameter compared to a one of the rotor sections on the delivery side.

5. The pump according to claim 3 wherein a first of the rotor sections on the suction side of each of said rotors is aluminum and a one of the rotor sections on the delivery side is steel.

6. The pump according to claim 3 wherein a one of the rotor sections on the suction side is produced with a wider tolerance compared to another of the rotor sections on the delivery side.

7. The pump according to claim 3 wherein the casing is partible.

8. The pump according to claim 7 wherein a separating plane between the two parts of the casing is identical to a separating plane between two of the rotor sections.

9. The pump according to claim 3 wherein a bore is provided in the casing which connects helical pump chambers at a plane where their cross section reduces to an outlet and in which a non-return valve is located, said 5 valve designed to open in the event of an overpressure.

10. The pump according to claim 3 further including a cooling/temperature equalization facility.

11. The pump according to claim 10 wherein the cooling/temperature facility cools the inside of the rotors.

12. The pump according to claim 11 wherein the cooling/temperature facility is located in a hollow space within each rotor, said hollow space being open in a direction along the bearing.

13. The pump according to claim 12 wherein the hollow space is defined in a hollow shaft on which the rotors are supported and further comprising a fixed cooling pipe opening into said hollow space.

14. The pump according to claim 12 further including a cooling bushing, supported by the casing, that protrudes into an annular chamber between the shaft and one of the rotors and the rotor sections.

15. The pump according to claim 11 wherein, the casing of the pump defines channels through which a coolant flows at the plane of the rotors.

16. The pump according to claim 15 wherein the channels through which a coolant flows extend to the bearings.

17. The pump according to claim 10 wherein a coolant flowing through the pump is identical with a lubricant for the bearings.

18. The pump according to claim 3 wherein a first of the rotor sections on the suction side of each of said rotors is a first material having at least one physical property suited to an operating condition on the suction side of the pump, and a second of the rotor sections on the delivery side of each of said rotors is a second material having at least one physical property suited to an operating condition on the delivery side of the pump.

19. In a method for manufacturing a screw vacuum pump including mounting rotors and bearings within a casing, the improvement comprising, for each rotor:

manufacturing a first rotor section of a first material within a first preselected precision tolerance range for employment on a suction side of the pump;

manufacturing a second rotor section of a second material different from the first material within a second preselected precision tolerance range for employment on a delivery side of the pump; and joining the first and second rotor sections by one of form-fitting and friction locking.

20. The method according to claim 19 wherein the second tolerance range is less than the first.

21. An evacuation apparatus comprising:

a housing having an inlet port and an outlet port;

a pump section arranged in said housing and having a suction side and an exhaust side, the pump section comprising a plurality of interengaging rotors contained in said housing, each of the rotors comprising first and second joined, separately manufactured helical rotor sections, said helical sections, together with said housing, defining a fluid-transporting space, said first and second helical rotor having at least one of (i) dissimilar thermal conductivity and (ii) dissimilar thermal expansion;

bearings for supporting rotating shafts of said rotors; and at least one motor for rotating the interengaging rotors.

* * * * *